US010763561B2

(12) United States Patent
Miyamoto

(10) Patent No.: US 10,763,561 B2
(45) Date of Patent: Sep. 1, 2020

(54) BAND-PASS FILTER AND CONTROL METHOD THEREOF

(71) Applicant: NEC Corporation, Minato-ku, Tokyo (JP)

(72) Inventor: Takahiro Miyamoto, Tokyo (JP)

(73) Assignee: NEC CORPORATION, Tokyo (JP)

( * ) Notice: Subject to any disclaimer, the term of this patent is extended or adjusted under 35 U.S.C. 154(b) by 7 days.

(21) Appl. No.: 16/301,827

(22) PCT Filed: May 2, 2017

(86) PCT No.: PCT/JP2017/017253
§ 371 (c)(1),
(2) Date: Nov. 15, 2018

(87) PCT Pub. No.: WO2017/199766
PCT Pub. Date: Nov. 23, 2017

(65) Prior Publication Data

US 2019/0157731 A1 May 23, 2019

(30) Foreign Application Priority Data

May 20, 2016 (JP) ..... 2016-101808

(51) Int. Cl.
*H01P 1/203* (2006.01)
*H01P 7/08* (2006.01)
(Continued)

(52) U.S. Cl.
CPC ..... *H01P 1/20* (2013.01); *H01P 1/203* (2013.01); *H01P 1/205* (2013.01);
(Continued)

(58) Field of Classification Search
CPC ..... H01P 1/20; H01P 1/203; H01P 1/20345; H01P 7/08
(Continued)

(56) References Cited

U.S. PATENT DOCUMENTS 4,821,005 A * 4/1989 Kling ..... H05K 1/0231 333/12
6,972,636 B2 * 12/2005 Murata ..... H01P 1/127 333/205
(Continued)

FOREIGN PATENT DOCUMENTS

EP 0614244 A1 9/1994
JP H06-97702 A 4/1994
(Continued)

OTHER PUBLICATIONS

International Search Report for PCT Application No. PCT/JP2017/017253, dated Jul. 18, 2017.

*Primary Examiner* — Rakesh B Patel

(57) ABSTRACT

There is provided a band-pass filter capable of easily changing a bandwidth of a pass band. A band-pass filter (1B) of the present disclosure includes: a housing (11), a plurality of resonant plates (12) stored in the housing (11), a first coupling conductor (15) connecting two adjacent resonant plates (12) of the plurality of resonant plates (12), and a second coupling conductor (16) arranged at a position affecting a coupling coefficient between the two adjacent resonant plates (12), wherein a distance from the resonant plate (12) to the second coupling conductor (16) is changeable.

8 Claims, 19 Drawing Sheets

(51) Int. Cl.
*H01P 1/20* (2006.01)
*H01P 1/205* (2006.01)
*H01P 7/04* (2006.01)

(52) U.S. Cl.
CPC ..... *H01P 1/20345* (2013.01); *H01P 7/04* (2013.01); *H01P 7/08* (2013.01)

(58) Field of Classification Search
USPC ..... 333/185
See application file for complete search history.

(56) References Cited

U.S. PATENT DOCUMENTS

| | | | | |
|---|---|---|---|---|
| 2002/0050872 | A1* | 5/2002 | Terashima ..... | H01P 1/203 333/99 S |
| 2015/0280298 | A1 | 10/2015 | Shiroyama et al. | |

FOREIGN PATENT DOCUMENTS

| | | | |
|---|---|---|---|
| JP | H07-226603 | A | 8/1995 |
| JP | H09-260902 | A | 10/1997 |
| JP | H09-307306 | A | 11/1997 |
| JP | 2009-055576 | A | 3/2009 |
| JP | 2014-086839 | A | 5/2014 |
| WO | 2004/019508 | A1 | 3/2004 |
| WO | 2008/019179 | A2 | 2/2008 |

* cited by examiner

BAND-PASS FILTER AND CONTROL METHOD THEREOF

This application is a National Stage Entry of PCT/JP2017/017253 filed on May 2, 2017, which claims priority from Japanese Patent Application 2016-101808 filed on May 20, 2016, the contents of all of which are incorporated herein by reference, in their entirety.

TECHNICAL FIELD

The present disclosure relates to a band-pass filter capable of changing a bandwidth of a pass band, and a control method of the band-pass filter.

BACKGROUND ART

In a wireless communication system that performs transmission and reception using a micro-wave band or a millimeter-wave band, a band-pass filter is used to pass signals in a predetermined frequency band and to remove unnecessary frequency components. Patent Literature 1 discloses a technique relating to a band-pass filter capable of changing a pass band.

Specifically, Patent Literature 1 discloses that a semi-coaxial resonant element is arranged inside a cavity resonator, and a movable conductor is arranged in a space between a cover covering the cavity resonator and an open end of the resonant element, and resonance frequency of the cavity resonator is changed by moving the movable conductor. Patent Literature 1 further discloses that a similar movable conductor is arranged in a space between two cavity resonators, and a coupling coefficient between two cavity resonators is changed by moving the movable conductor to change a bandwidth of a pass band.

CITATION LIST

Patent Literature

Patent Literature 1: Japanese Unexamined Patent Application Publication No. 2014-086839

SUMMARY OF INVENTION

Technical Problem

However, the technique disclosed in Patent Literature 1 relates to a filter for changing a frequency. Thus, although the movable conductor for changing a bandwidth of a pass band is independently moved, the variable range of the bandwidth is narrow, and the effect of varying the bandwidth is small. In addition, no mechanism for changing an external Q factor is disclosed, and the filter characteristics are deteriorated as the bandwidth is changed.

In view of the above, a purpose of the present disclosure is to provide a band-pass filter that solves the above problems and is capable of easily changing a bandwidth of a pass band, and a control method of the band-pass filter.

Solution to Problem

In one example aspect, a band-pass filter comprising:

a housing;

a plurality of resonant plates stored in the housing;

a first coupling conductor connecting two adjacent resonant plates of the plurality of resonant plates; and a second coupling conductor arranged at a position affecting a coupling coefficient between the two adjacent resonant plates, wherein a distance from the resonant plate to the second coupling conductor is changeable.

In one example aspect, a control method of a band-pass filter including a plurality of resonant plates stored in a housing, the control method comprising:

connecting two adjacent resonant plates of the plurality of resonant plates by a first coupling conductor;

arranging a second coupling conductor at a position affecting a coupling coefficient between the two adjacent resonant plates; and changing a distance from the resonant plate to the second coupling conductor.

Advantageous Effects of Invention

According to the above aspects, it is possible to provide a band-pass filter capable of easily changing a bandwidth of a pass band, and a control method of the band-pass filter.

DESCRIPTION OF EMBODIMENTS

Hereinafter, embodiments of the present disclosure are described with reference to the drawings. Note that, specific numerical values to be used in the following embodiments are merely examples in order for the present discloser to be easily understood, and are not limited thereto.

(1) First Embodiment

Figure 1:
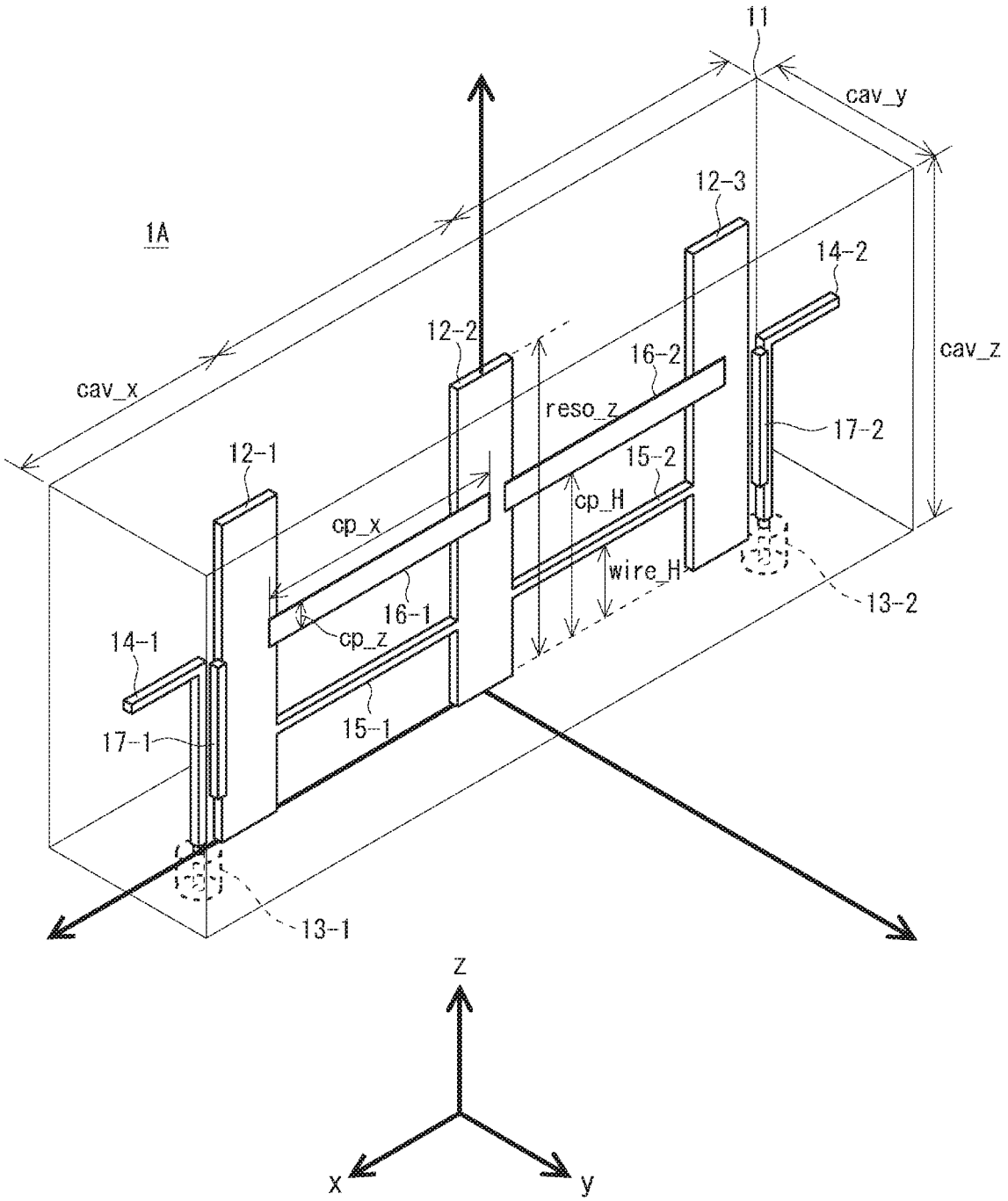
FIG. 1 is a perspective view showing an example of a band-pass filter according to a first embodiment.
Figure 2:
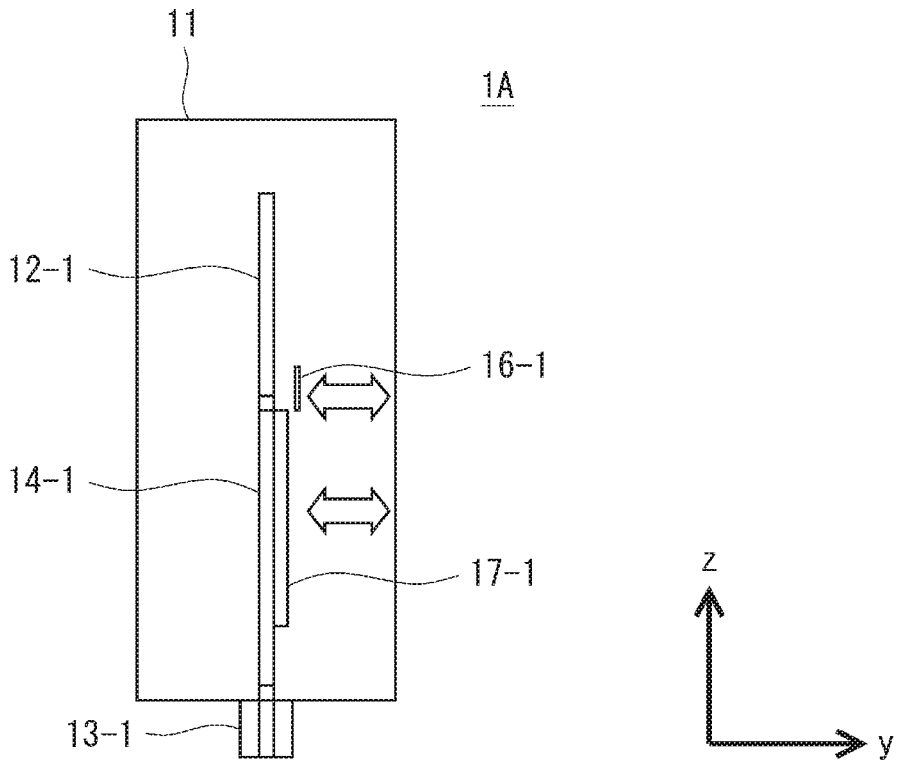
FIG. 2 is a side view showing an example of a band-pass filter according to the first embodiment.
Figure 3:
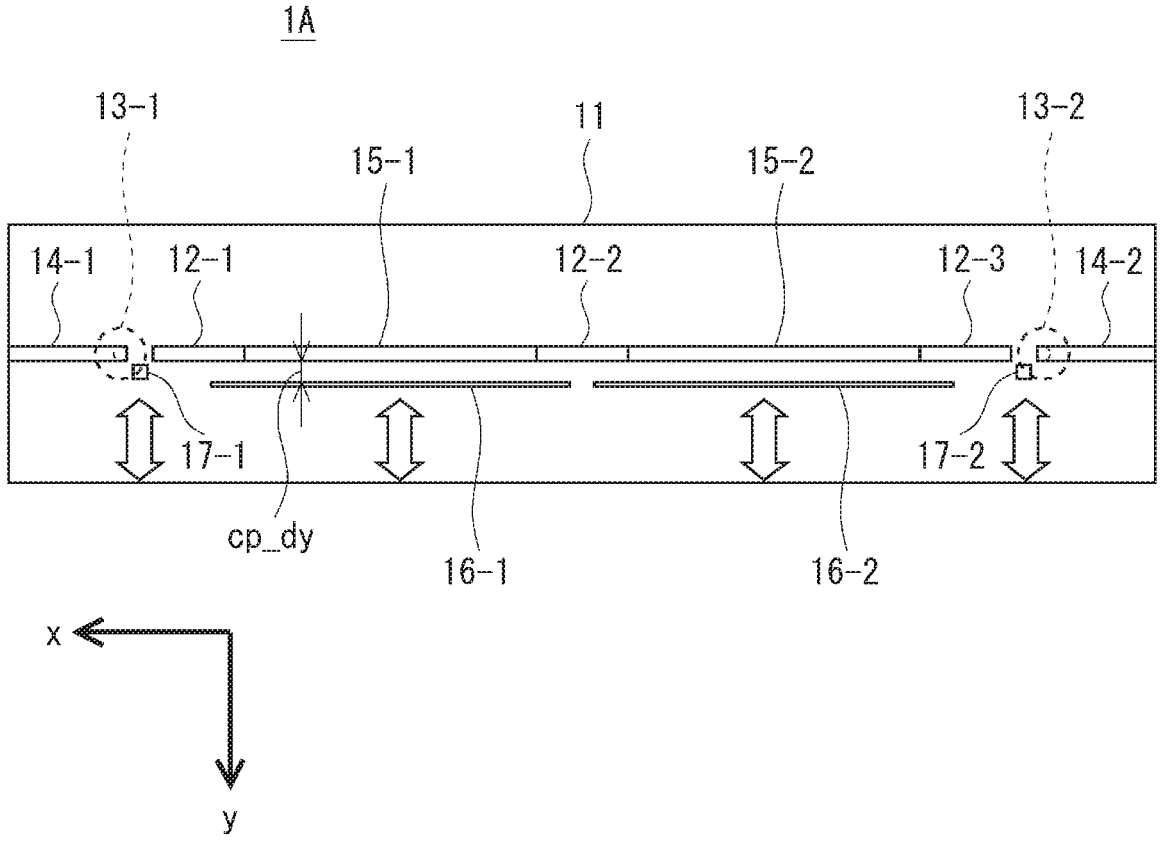
FIG. 3 is a top view showing an example of a band-pass filter according to the first embodiment.

FIGS. 1 to 3 are respectively a perspective view, a side view, and a top view showing an example of a band-pass filter 1A according to a first embodiment.

As shown in FIGS. 1 to 3, the band-pass filter 1A according to the first embodiment is a band-pass filter capable of changing a bandwidth of a pass band, and includes a housing 11, three resonant plates 12-1 to 12-3, two input/output ports 13-1 and 13-2, two loop antennas 14-1 and 14-2, two first coupling conductors 15-1 and 15-2, two second coupling conductors 16-1 and 16-2, and two third coupling conductors 17-1 and 17-2. In the following description, the resonant plates 12-1 to 12-3 are simply referred to as a "resonant plate 12" unless especially distinguished. Similarly, the input/output ports 13-1 and 13-2 are simply referred to as an "input/output port 13", the loop antennas 14-1 and 14-2 are simply referred to as a "loop antenna 14", the first coupling conductors 15-1 and 15-2 are simply referred to as a "first coupling conductor 15", the second coupling conductors 16-1 and 16-2 are simply referred to as a "second coupling conductor 16", and the third coupling conductors 17-1 and 17-2 are simply referred to as a "third coupling conductor 17".

The band-pass filter 1A according to the first embodiment has a three-stage configuration including the three resonant plates 12-1 to 12-3. However, the number of stages of the band-pass filter 1A according to the first embodiment is not limited as long as the band-pass filter 1A has two or more stages.

In the first embodiment, it is assumed that, in FIGS. 1 to 3, the center position of the contact surface of the second-stage resonant plate 12-2 with the bottom face of the housing 11 is the origin point, the direction in which the resonant plates 12-1 to 12-3 are arranged is an x direction, the direction orthogonal to the principal surfaces (a surface having the largest area) of the resonant plates 12-1 to 12-3 is a y direction, and the longitudinal direction of the resonant plates 12-1 to 12-3 is a z direction.

The housing 11 has a cavity inside, and is a conductive member for storing the resonant plates 12-1 to 12-3 in the cavity. The housing 11 is constituted by, for example, a casing having a recessed portion capable of storing the resonant plates 12-1 to 12-3 and a cover covering the opening of the casing.

The resonant plates 12-1 to 12-3 are semi-coaxial resonators formed of plate-shaped conductors each having one end connected to the bottom face of the housing 11 and the other end which is an open end (that is, the other end is not connected to any member). The resonant plates 12-1 to 12-3 are arranged in the x direction so that the side faces are opposed to each other. Since the resonant plates 12-1 to 12-3 each have a plate shape, it is possible for the resonant plates 12-1 to 12-3 to be formed integrally with the first coupling conductors 15-1 and 15-2 and to be strongly spacially coupled with the second coupling conductors 16-1 and 16-2. The material of the resonant plates 12-1 to 12-3 is only required to be metal having high conductivity, and is, for example, copper. The resonant plates 12-1 to 12-3 resonate at a resonance frequency determined by the shape, the length (z direction), and the like.

The input/output ports 13-1 and 13-2 input and output high-frequency signals. The input/output port 13-1 is constituted by a coaxial line, and an internal conductor of the coaxial line serves as the loop antenna 14-1. The input/output port 13-1 is inserted from the bottom face of the housing 11 at one end of the housing 11 in the x direction (at the side of the resonant plate 12-1), and connected to the resonant plate 12-1 by the loop antenna 14-1 by electromagnetic coupling. The input/output port 13-2 is constituted by a coaxial line, and an internal conductor of the coaxial line serves as the loop antenna 14-2. The input/output port 13-2 is inserted from the bottom face of the housing 11 at the other end of the housing 11 in the x direction (at the side of the resonant plate 12-3), and connected to the resonant plate 12-3 by the loop antenna 14-2 by electromagnetic coupling. One of the input/output ports 13-1 and 13-2 serves as an input port, and the other serves as an output port. For example, when the input/output port 13-1 serves as the input port and the input/output port 13-2 serves as the output port, high-frequency signals are input to the input/output port 13-1, and the high-frequency signals within the pass band of the band-pass filter 1A among the input signals are output from the input/output port 13-2. Each of the loop antennas 14-1 and 14-2 may have a shape other than a loop shape, such as a simple rod shape.

The first coupling conductor 15-1 is a plate-shaped conductor connecting the two adjacent resonant plates 12-1 and 12-2. The first coupling conductor 15-2 is a plate-shaped conductor connecting the two adjacent resonant plates 12-2 and 12-3. Specifically, the first coupling conductor 15 connects the two adjacent resonant plates 12 on the side faces of the resonant plates 12 at a position other than the open ends of the resonant plates 12. In the first embodiment, by designing the shape and the position of the first coupling conductor 15 so as to connect the two adjacent resonant plates 12, it is possible to obtain a desired coupling coefficient (or a coupling amount) between the two adjacent resonant plates 12. In this manner, the coupling coefficient is determined by the shape and the position of the first coupling conductor 15, and a partition plate, which is often used for a semi-coaxial filter, for partitioning the two adjacent resonant plates 12 is unnecessary. Since the first coupling conductors 15-1 and 15-2 each have a plate shape, it is possible for the first coupling conductors 15-1 and 15-2 to be integrally formed with the resonant plates 12-1 to 12-3. The material of the first coupling conductors 15-1 and 15-2 is only required to be metal having high conductivity, and is, for example, copper. The closer the position (wire_H) of the first coupling conductors 15-1 and 15-2 in the z direction with respect to the open ends of the resonant plates 12-1 to 12-3, the higher the coupling coefficient between the two adjacent resonant plates 12. Thus, the position of the first coupling conductors 15-1 and 15-2 in the z direction is at a position where a desired coupling coefficient is obtained.

The second coupling conductor 16-1 is a plate-shaped conductor arranged at a position affecting the coupling coefficient between the two adjacent resonant plates 12-1 and 12-2. The second coupling conductor 16-2 is a plate-shaped conductor arranged at a position affecting the coupling coefficient between the two adjacent resonant plates 12-2 and 12-3. Since the second coupling conductors 16-1 and 16-2 each have a plate shape, it is possible for the second coupling conductors 16-1 and 16-2 to be strongly spacially coupled with the resonant plates 12-1 to 12-3.

The second coupling conductor 16-1 is arranged so that its principal surface is opposed to the principal surfaces of the resonant plates 12-1 to 12-3, and extends over the resonant plates 12-1 and 12-2 in the x direction. The second coupling conductor 16-2 is arranged so that its principal surface is opposed to the principal surfaces of the resonant plates 12-1 to 12-3, and extends over the resonant plates 12-2 and 12-3 in the x direction. When the position (cp_H) of the second coupling conductors 16-1 and 16-2 in the z direction is closer to the bottom face of the housing 11 than that of the first coupling conductors 15-1 and 15-2, although the distance (y direction; cp_dy) from the resonant plates 12-1 to 12-3 to the second coupling conductors 16-1 and 16-2 is changed, the coupling coefficient between the two adjacent resonant plates 12 is only slightly changed. Thus, the position of the second coupling conductors 16-1 and 16-2 in the z direction is closer to the open ends of the resonant plates 12-1 to 12-3 than that of the first coupling conductors 15-1 and 15-2. In addition, the closer the position of the second coupling conductors 16-1 and 16-2 in the z direction with respect to the open ends of the resonant plates 12-1 to 12-3, the steeper the change of the coupling coefficient between the two adjacent resonant plates 12 when the distance cp_dy is changed. Thus, the position of the second coupling conductors 16-1 and 16-2 in the z direction is closer to the open ends of the resonant plates 12-1 to 12-3 than that of the first coupling conductors 15-1 and 15-2, and is a position where the coupling coefficient is changed as desired.

In the first embodiment, the distance (y direction; cp_dy) from the resonant plates 12-1 to 12-3 to the second coupling conductors 16-1 and 16-2 is changeable as described above. In order to change the distance cp_dy, the position of the resonant plates 12-1 to 12-3 is fixed, and the position of the second coupling conductors 16-1 and 16-2 in the y direction is changed (this changing method is to be described later). When the distance cp_dy is changed, the coupling coefficient between the two adjacent resonant plates 12 is changed. Specifically, the shorter the distance cp_dy (the closer the second coupling conductors 16-1 and 16-2 with respect to the resonant plates 12-1 to 12-3), the smaller the coupling coefficient, and the narrower the bandwidth of the pass band. On the other hand, the longer the distance cp_dy (the farther the second coupling conductors 16-1 and 16-2 with respect to the resonant plates 12-1 to 12-3), the larger the coupling coefficient, and the broader the bandwidth of the pass band. However, the coupling coefficient does not exceed a coupling coefficient determined by the position of the first coupling conductors 15-1 and 15-2 in the z direction. Thus, by setting the coupling coefficient determined by the position of the first coupling conductors 15-1 and 15-2 in the z direction as the maximum value, and changing the coupling coefficient by the distance cp_dy, it is possible to change the bandwidth of the pass band.

The material of the second coupling conductors 16-1 and 16-2 is only required to be metal having high conductivity, and is, for example, copper. The longer the length (x direction; cp_x) of the principal surfaces of the second coupling conductors 16-1 and 16-2 and the wider the width (z direction; cp_z), the gentler the change of the coupling coefficient between the two adjacent resonant plates 12 when the distance cp_dy is changed. Thus, the length and width of the principal surfaces of the second coupling conductors 16-1 and 16-2 are a length and width at which the coupling coefficient is changed as desired.

The third coupling conductor 17-1 is arranged at a position affecting an external Q factor between the input/output port 13-1 and the resonant plate 12-1. The third coupling conductor 17-2 is arranged at a position affecting the external Q factor between the input/output port 13-2 and the resonant plate 12-3.

The third coupling conductors 17-1 and 17-2 are provided to change the reflection delay of the input/output stage of the band-pass filter 1A. The reflection delay is changed to adjust the external Q factor (so that it is consistent with an external circuit). The reflection delay is the amount of delay of a reflection signal with respect to an incident signal when a measurement object measured by a network analyzer is set as a first-stage resonator, and is uniquely determined according to the external Q factor. For example, when it is assumed that the reflection delay between the resonant plate 12-1 and the input/output port 13-1 is $\tau_p$, that the external Q factor between the resonant plate 12-1 and the input/output port 13-1 is $Q_{ext}$, and that the resonance frequency of the resonant plate 12-1 is $f_p$, the relationship between $\tau_p$ and $Q_{ext}$ is expressed by the following expression.

$$Q_{ext} = \frac{2\pi f_p(\tau_p - \tau_\infty)}{4} \quad \text{[Expression 1]}$$

where, $\tau_\infty=0$ may hold.

The position of the third coupling conductor 17-1 in the x direction is a position between the input/output port 13-1 and the resonant plate 12-1, and the position in the z direction may be an arbitrary position. The position of the third coupling conductor 17-2 in the x direction is a position between the input/output port 13-2 and the resonant plate 12-3, and the position in the z direction is an arbitrary position.

Figure 4:
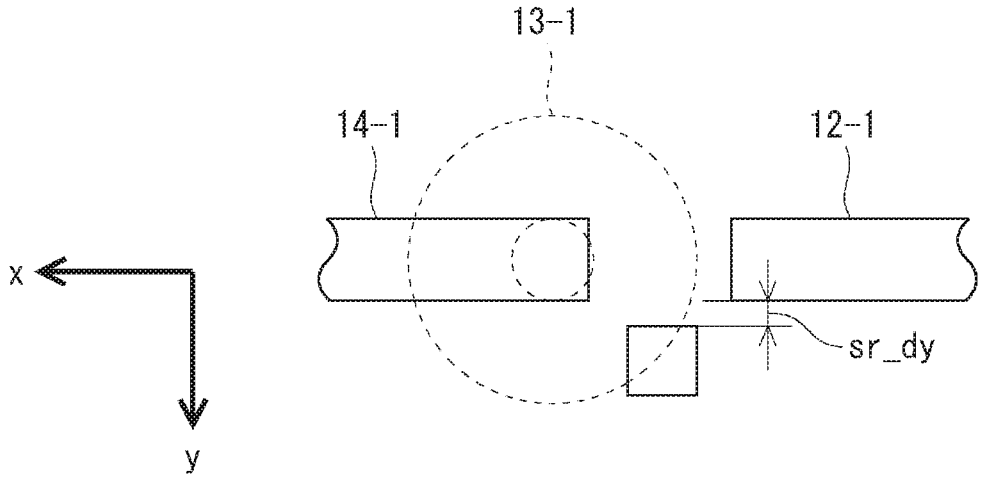
FIG. 4 is a diagram showing an example of a distance (sr_dy) from a resonator to a third coupling conductor.

In the first embodiment, the distance (y direction) from the resonant plates 12-1 to 12-3 to the third coupling conductors 17-1 and 17-2 is changeable. The distance is represented by sr_dy as shown in FIG. 4. FIG. 4 corresponds to the enlarged diagram around the third coupling conductor 17-1 in FIG. 3. In order to change the distance sr_dy, the position of the resonant plates 12-1 to 12-3 is fixed, and the position of the third coupling conductors 17-1 and 17-2 in the y direction is changed (this changing method is to be described later). When the distance sr_dy is changed, the reflection delay between the resonant plate 12-1 and the input/output port 13-1, and the reflection delay between the resonant plate 12-3 and the input/output port 13-2 are changed. Specifically, the shorter the distance sr_dy (the closer the third coupling conductors 17-1 and 17-2 with respect to the resonant plates 12-1 to 12-3), the smaller the reflection delay, and the longer the distance sr_dy (the farther the third coupling conductors 17-1 and 17-2 with respect to the resonant plates 12-1 to 12-3), the larger the reflection delay. Thus, it is possible to change the reflection delay by the distance sr_dy.

The material of the third coupling conductors 17-1 and 17-2 is only required to be metal having high conductivity, and is, for example, copper. The third coupling conductors 17-1 and 17-2 may each have a plate shape, a cylindrical shape, a polygonal prism shape, or the like. However, when, for example, the third coupling conductors 17-1 and 17-2 have quadrangular prism shapes compared to plate shapes, the reflection delay between the resonant plate 12-1 and the input/output port 13-1 and the reflection delay between the resonant plate 12-3 and the input/output port 13-2 are more gently changed when the distance sr_dy is changed than when the third coupling conductors 17-1 and 17-2 have plate shapes. Thus, the third coupling conductors 17-1 and 17-2 have quadrangular prism shapes in FIGS. 1 to 3.

The method for changing the above distances cp_dy and sr_dy is described below.

In the first embodiment, the second coupling conductors 16-1 and 16-2 and the third coupling conductors 17-1 and 17-2 are mounted on a substrate, and the principal surface of the substrate is opposed to the principal surfaces of the resonant plates 12-1 to 12-3. Then, the positions in the y direction of the second coupling conductors 16-1 and 16-2 and the third coupling conductors 17-1 and 17-2 mounted on the substrate are changed to change the distances cp_dy and sr_dy.

Figure 5:
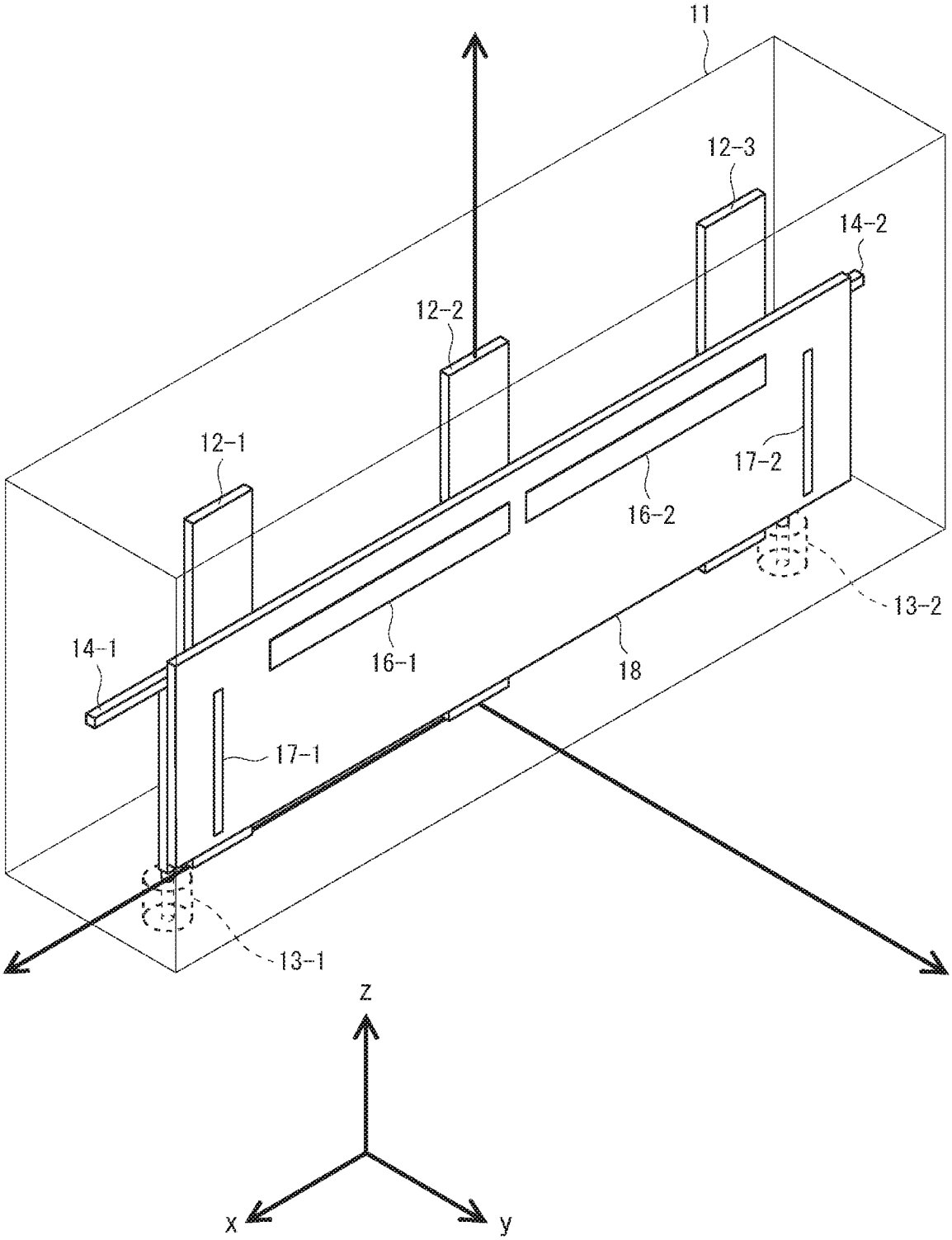
FIG. 5 is a perspective view showing an example of the band-pass filter according to the first embodiment to which a substrate is mounted.
Figure 6:
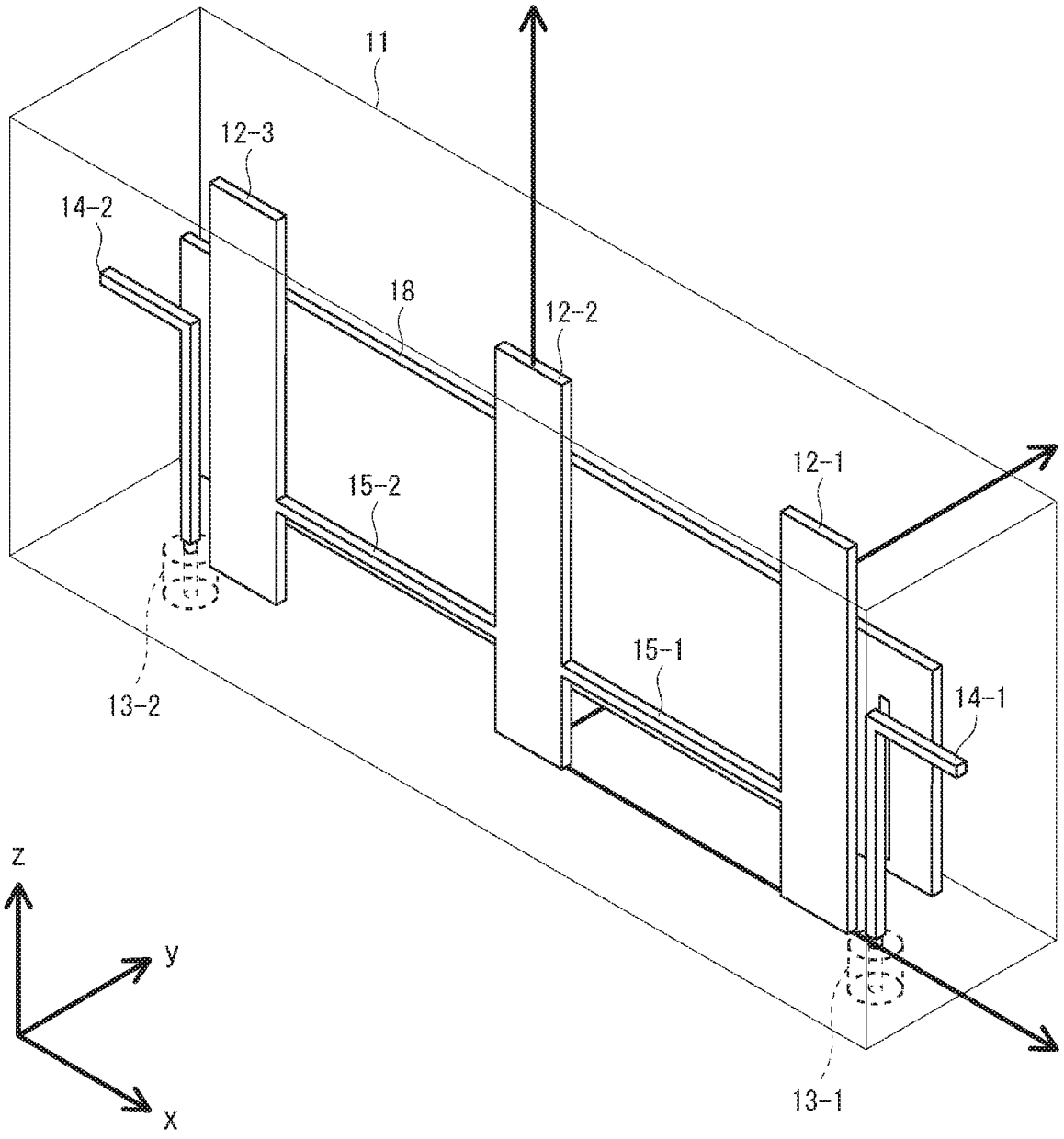
FIG. 6 is a perspective view of the band-pass filter in FIG. 5 when viewed from the back side.

In the example shown in FIGS. 5 and 6, the second coupling conductors 16-1 and 16-2 are mounted on a surface of a substrate 18. The surface on the back side of the above surface thereof is opposed to the resonant plates 12-1 to 12-3. Since the third coupling conductors 17-1 and 17-2 have quadrangular prism shapes and are thick, the third coupling conductors 17-1 and 17-2 are mounted on both surfaces of the substrate 18, and connect both surfaces via through holes.

Figure 7:
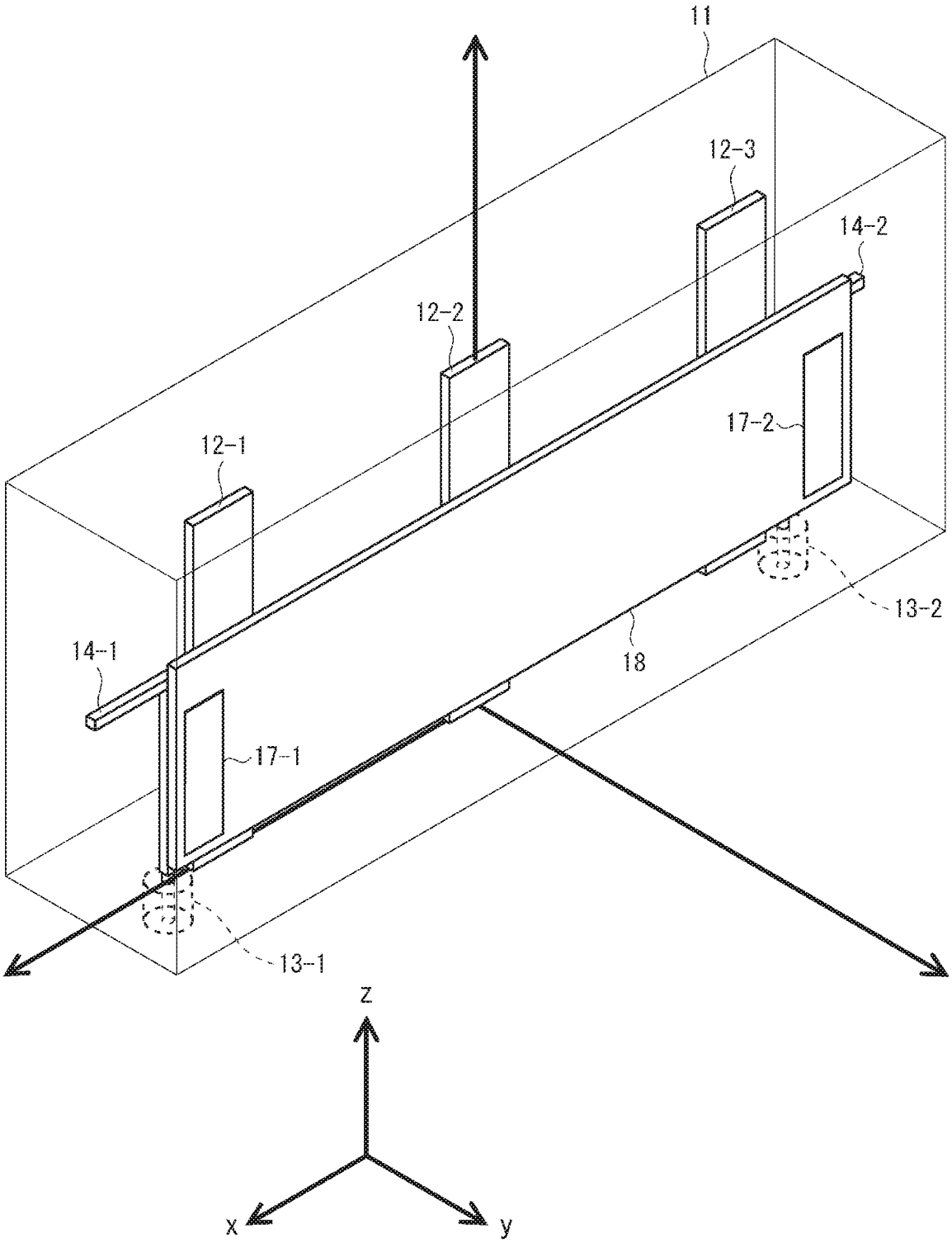
FIG. 7 is a perspective view showing an example of the band-pass filter according to the first embodiment to which a substrate is mounted.
Figure 8:
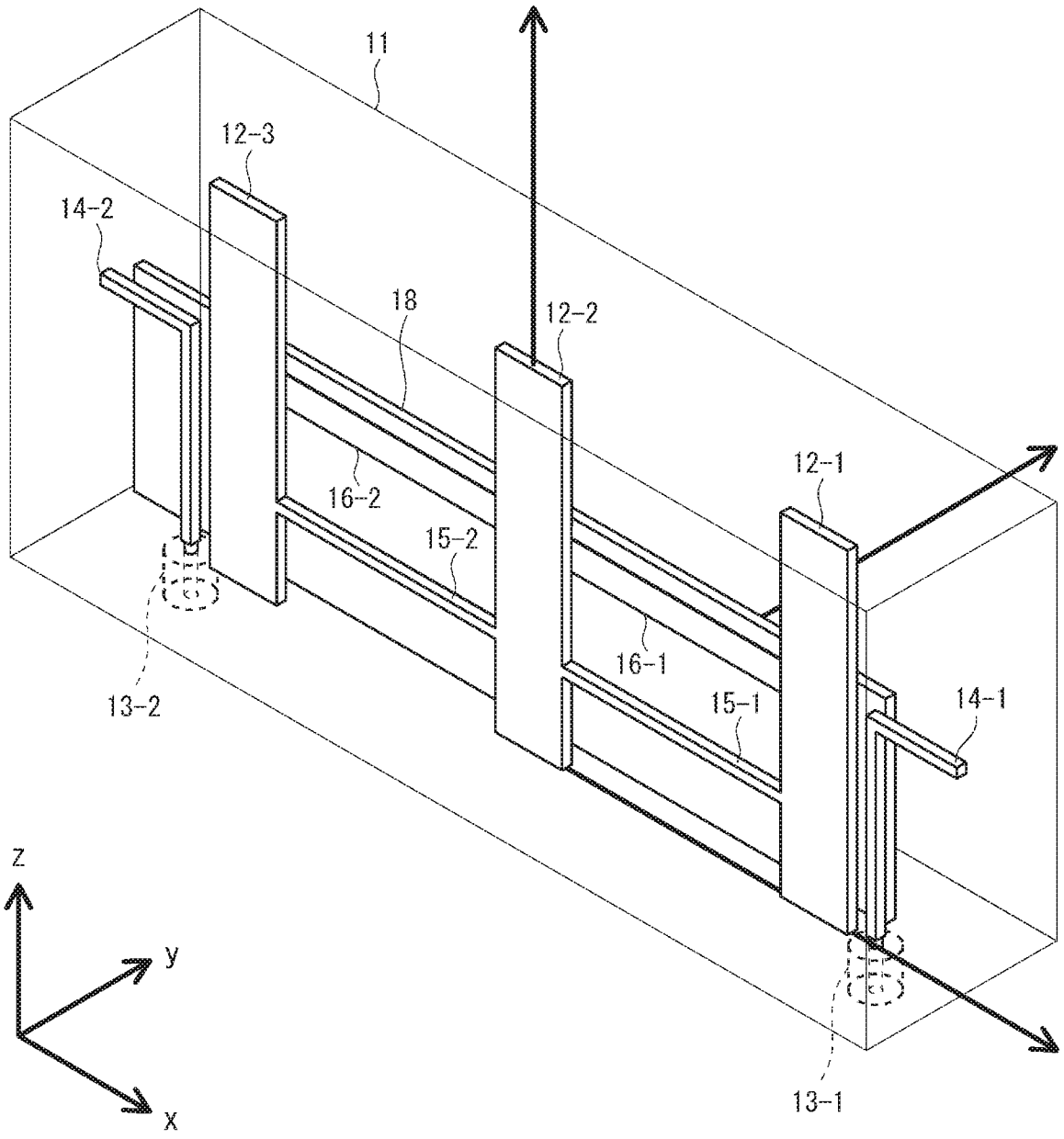
FIG. 8 is a perspective view of the band-pass filter in FIG. 7 when viewed from the back side.

In the example shown in FIGS. 7 and 8, the second coupling conductors 16-1 and 16-2 are mounted on a surface of the substrate 18 opposed to the resonant plates 12-1 to 12-3. The third coupling conductors 17-1 and 17-2 have thin plate shapes, not quadrangular prism shapes. Thus, the third coupling conductors 17-1 and 17-2 are mounted only on one surface (the surface on the back side of the one surface opposed to the resonant plates 12-1 to 12-3) of the substrate 18.

Figure 9:
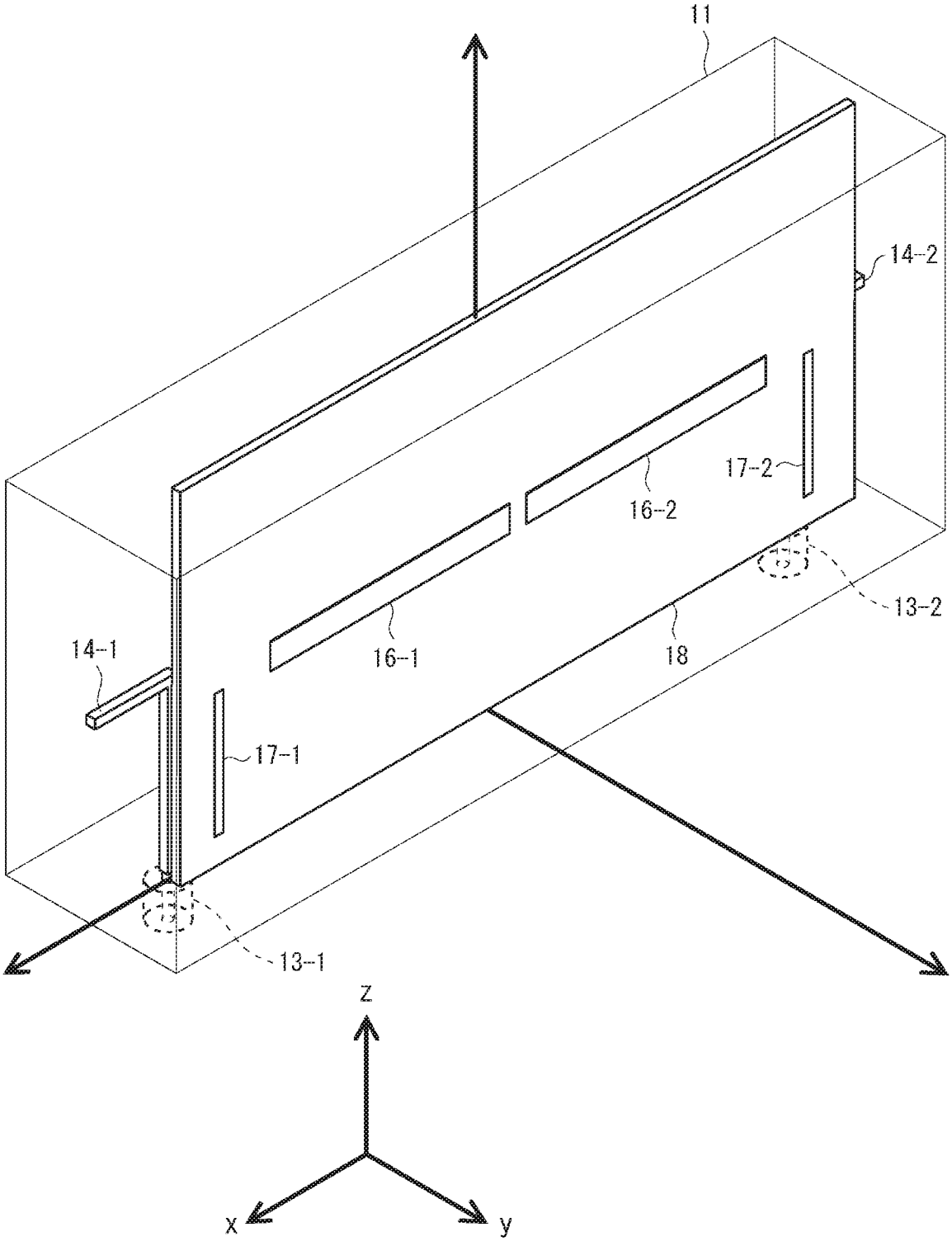
FIG. 9 is a perspective view showing an example of the band-pass filter according to the first embodiment to which a substrate is mounted.
Figure 10:
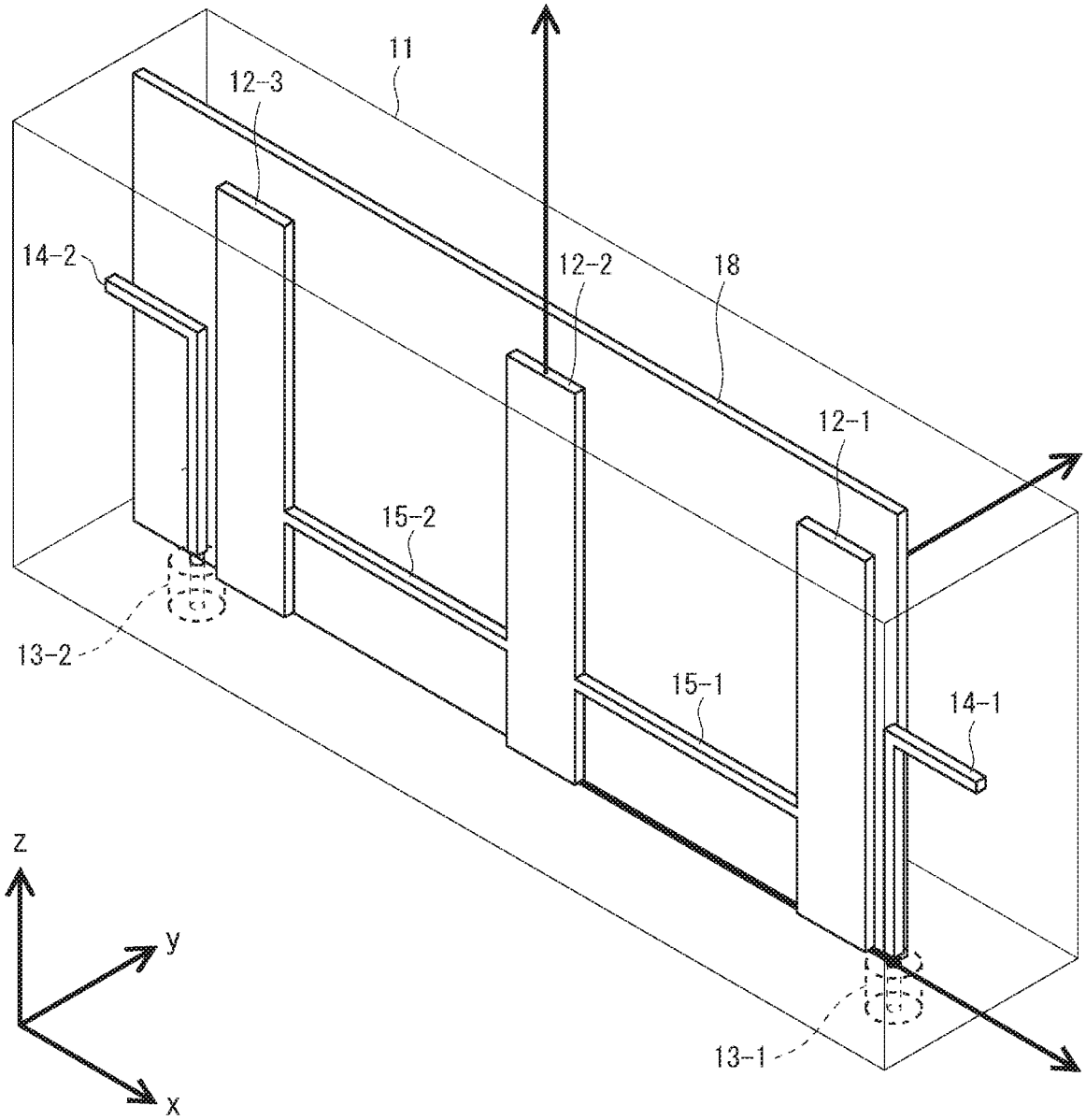
FIG. 10 is a perspective view of the band-pass filter in FIG. 9 when viewed from the back side.

In the example shown in FIGS. 9 and 10, the second coupling conductors 16-1 and 16-2 are mounted on a surface of the substrate 18. The surface on the back side of the above surface thereof is opposed to the resonant plates 12-1 to 12-3. Since the third coupling conductors 17-1 and 17-2 have quadrangular prism shapes and are thick, the third coupling conductors 17-1 and 17-2 are mounted on both surfaces of the substrate 18, and connect both surfaces via through holes.

As described above, the third coupling conductors 17-1 and 17-2 may be mounted on one surface of the substrate 18, or on both surfaces of the substrate 18 and connect both surfaces via through holes. The second coupling conductors 16-1 and 16-2 may be mounted on one surface of the substrate 18, or on both surfaces of the substrate 18 and connect both surfaces via through holes when the second coupling conductors 16-1 and 16-2 are thick. When mounted on one surface of the substrate 18, the second coupling conductors 16-1 and 16-2 and the third coupling conductors 17-1 and 17-2 may be mounted either on the surface opposed to the resonant plates 12-1 to 12-3 or on the surface on the back side of the above surface.

In the case of the substrate 18 shown in FIGS. 5 to 8, by attaching a supporting rod (now shown) to the substrate 18 and moving the supporting rod in the y direction using a stepping motor (now shown) provided outside the band-pass filter 1A, the substrate 18 is configured to be movable in the y direction. Then, by moving the substrate 18 in the y direction to change the positions in the y direction of the second coupling conductors 16-1 and 16-2 and the third coupling conductors 17-1 and 17-2, it is possible to change the distances cp_dy and sr_dy. At this time, by determining the shape of the third coupling conductor 17 so that it corresponds to the inclination of the coupling amount determined by the second coupling conductor 16, it is possible to consecutively change the distances cp_dy and sr_dy using the stepping motor without deteriorating the filter characteristic. In addition, it is possible to change the distances cp_dy and sr_dy separately using respective stepping motors.

On the other hand, in the case of the substrate 18 shown in FIGS. 9 and 10, the substrate 18 is configured to be attachable to and detachable from a substrate mounting part (now shown) in the housing 11. The substrate mounting part is only required to have a structure in which the substrate 18 is attachable and detachable, such as a slot into which the substrate 18 is inserted. Furthermore, a plurality of substrates 18 manufactured so as to have different distances cp_dy and sr_dy from each other when mounted to the housing 11 is to be prepared. Such substrates 18 can be manufactured by, for example, changing the substrate thickness, the mounting height, the mounding surface, or the like. Then, the substrate 18 mounted to the housing 11 is replaced with another substrate 18 having different distances cp_dy and sr_dy. Accordingly, the positions of the second coupling conductors 16-1 and 16-2 and the third coupling conductors 17-1 and 17-2 in the y direction are changed, and it is possible to change the distances cp_dy and sr_dy.

A filter characteristic (a simulation result) of the band-pass filter 1A according to the first embodiment is described below.

Here, it is assumed that the distances cp_dy and sr_dy are changed by preparing four substrates #1 to #4 as the substrates 18, and sequentially replacing the substrates #1 to #4.

Furthermore, in order to obtain a band-pass filter having the center frequency of 2.0 [GHz], it is assumed that the band-pass filter 1A is configured in the following conditions:

the length of the housing 11 (z direction) cav_z: 40 [mm];

the width of the housing 11 (x direction) cav_x: 30 [mm];

the depth of the housing 11 (y direction) cav_y: 20 [mm];

the length of the resonant plate 12 (z direction) reso_z: 35 [mm];

the width of the resonant plate 12 (x direction): 7 [mm];

the thickness of the resonant plate 12 (y direction): 1 [mm];

the position of the first coupling conductor 15 (z direction) wire_H: 9 [mm];

the width of the first coupling conductor 15 (z direction): 1 [mm];

the thickness of the first coupling conductor 15 (y direction): 1 [mm];

the position of the second coupling conductor 16 (z direction) cp_H: 20 [mm];

the length of the second coupling conductor 16 (x direction) cp_x: 28 [mm];

the width of the second coupling conductor 16 (z direction) cp_z: 3 [mm];

the thickness of the second coupling conductor 16 (y direction): 0.018 [mm];

the length of the third coupling conductor 17 (z direction): 15 [mm];

the width of the third coupling conductor 17 (x direction): 1 [mm]; and the depth of the third coupling conductor 17 (y direction): 1 [mm].

Note that, the distance cav_x is equivalent to, when it is assumed that the housing 11 is divided into three housings for storing three respective resonant plates 12, the length of each housing in the x direction.

Furthermore, it is assumed that the distances cp_dy and sr_dy when the substrates #1 to #4 are mounted to the housing 11 are as follows:

TABLE 1

| | sr_dy | cp_dy | bandwidth |
|---|---|---|---|
| substrate #1 | 1 mm | 1.9 mm | 73 MHz |
| substrate #2 | 0.6 mm | 2.25 mm | 83 MHz |
| substrate #3 | 0.2 mm | 2.9 mm | 96 MHz |
| substrate #4 | 0 mm | 3.1 mm | 102 MHz |

Figure 11:
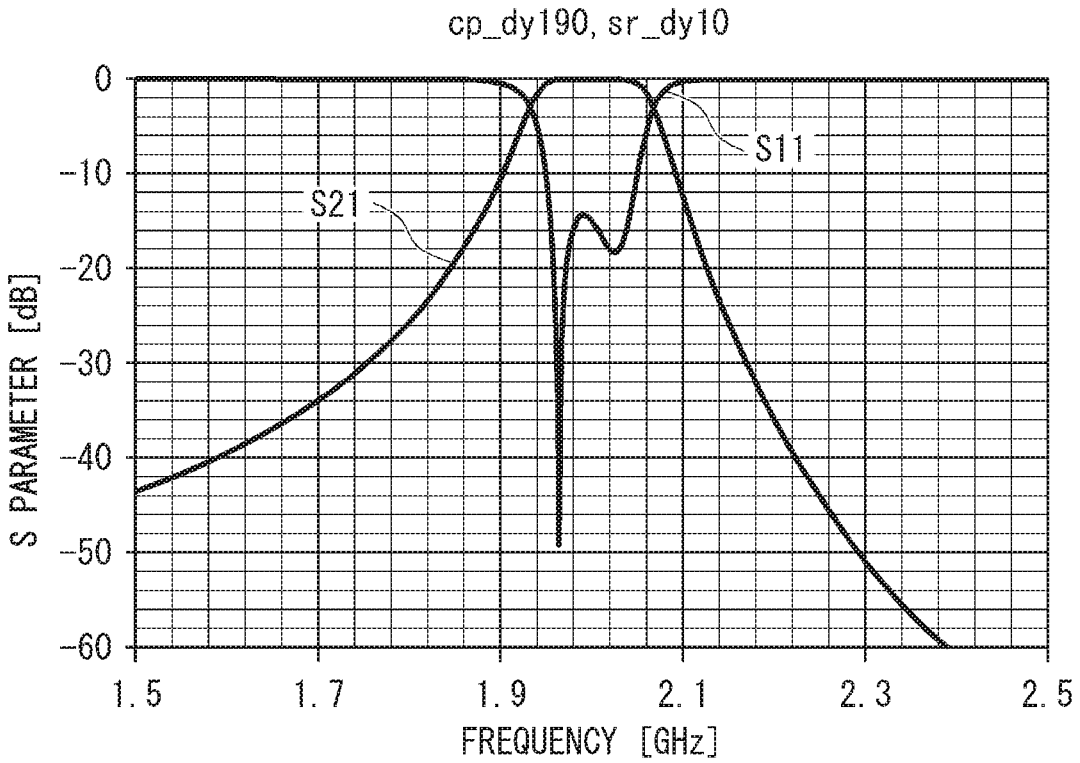
FIG. 11 is a diagram showing an example of a filter characteristic of the band-pass filter according to the first embodiment.
Figure 12:
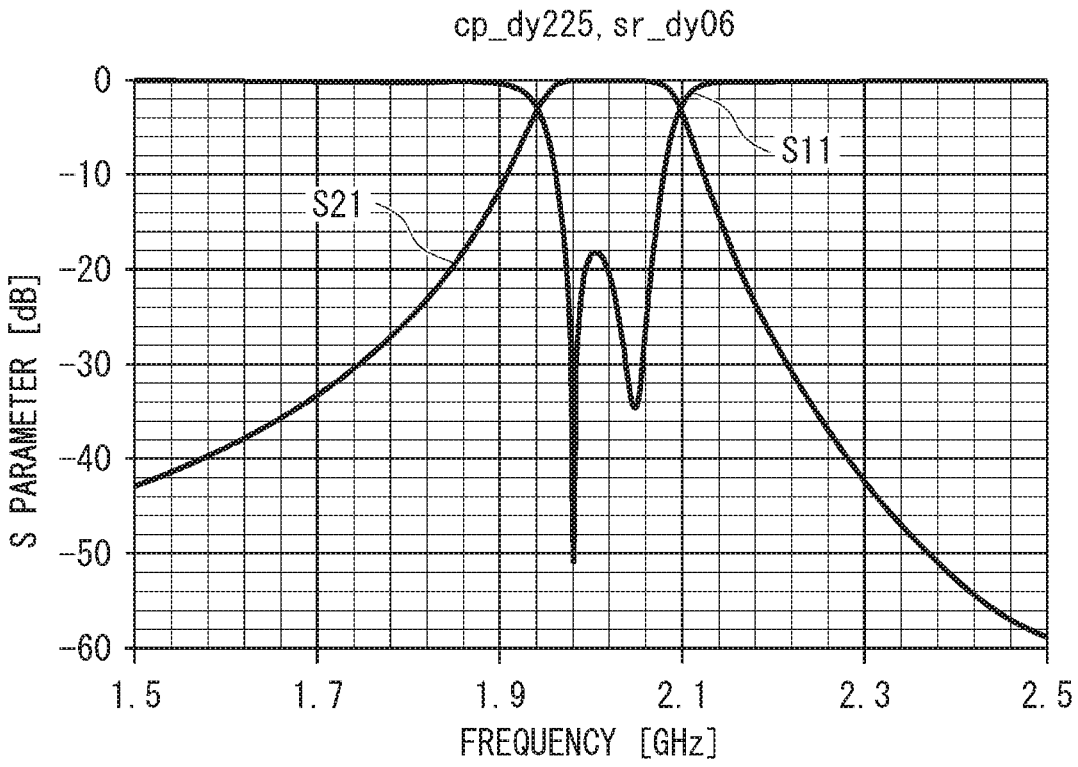
FIG. 12 is a diagram showing an example of a filter characteristic of the band-pass filter according to the first embodiment.
Figure 13:
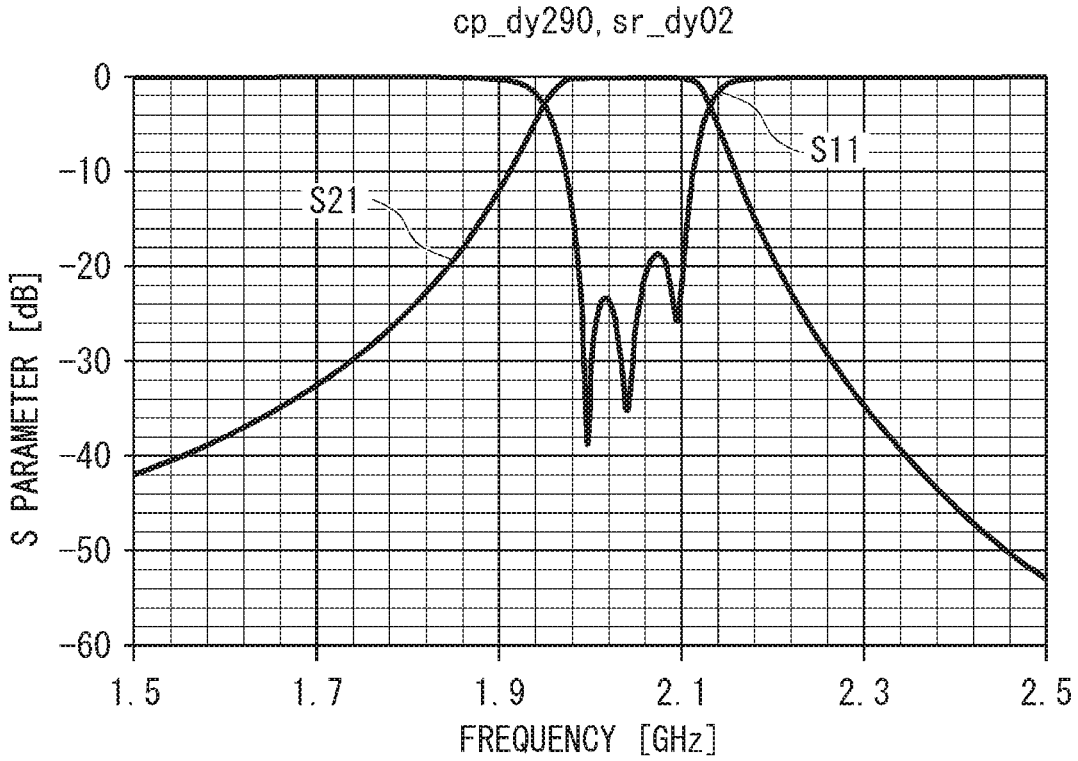
FIG. 13 is a diagram showing an example of a filter characteristic of the band-pass filter according to the first embodiment.
Figure 14:
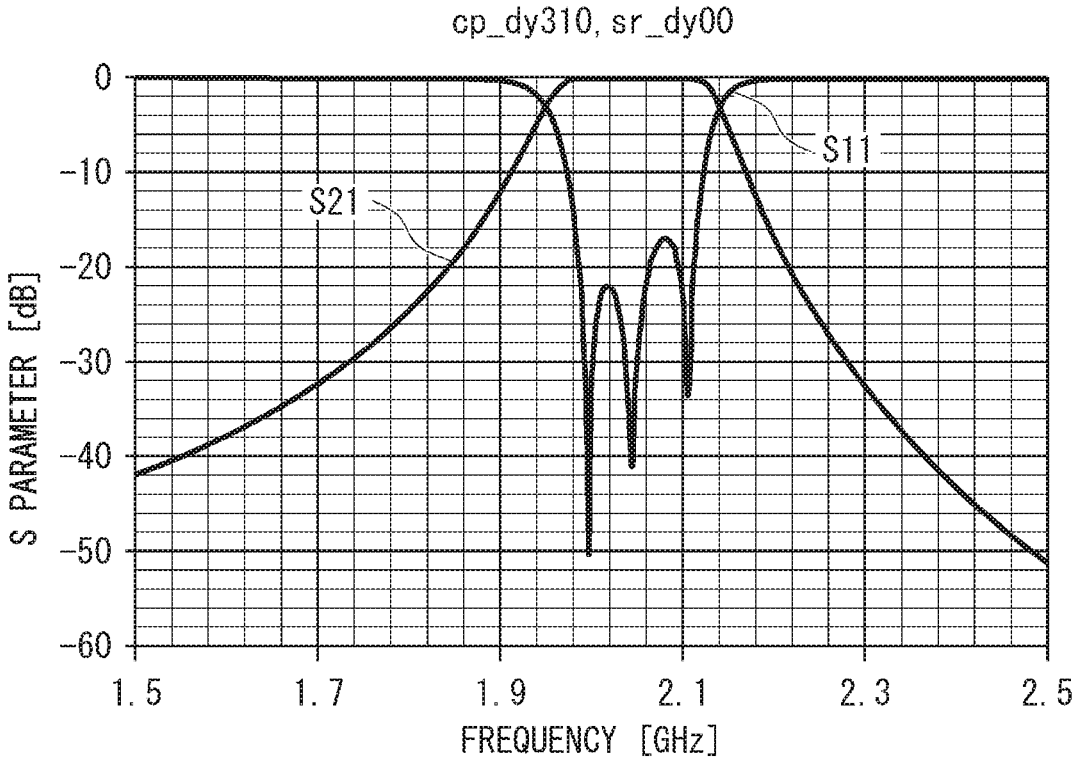
FIG. 14 is a diagram showing an example of a filter characteristic of the band-pass filter according to the first embodiment.

FIG. 11 shows an example of a filter characteristic when the substrate #1 is mounted to the band-pass filter 1A according to the first embodiment. Similarly, FIGS. 12 to 14 show respective filter characteristics when the substrates #2 to #4 are mounted. In FIGS. 11 to 14, each abscissa indicates a frequency [GHz], and each ordinate indicates S11 and S21 [dB] of the S parameter. S11 indicates return loss, and shows the reflection characteristic of a high-frequency signal. S21 indicates insertion loss, and shows the pass characteristic of a high-frequency signal.

In the example shown in FIG. 11, S21 shows the pass characteristic that its lower-limit frequency is 1.95 [GHz] and its peak is in a frequency band having the width of 73 [MHz]. S11 shows the reflection characteristic in a similar frequency band. Thus, the band-pass filter 1A, to which the substrate #1 is mounted, functions as a pass band filter having a pass band the bandwidth of which is 73 [MHz]. Similarly, in the example shown in FIG. 12, the band-pass filter 1A, to which the substrate #2 is mounted, functions as a pass band filter having a pass band the bandwidth of which is 83 [MHz]. In the example shown in FIG. 13, the band-pass filter 1A, to which the substrate #3 is mounted, functions as a pass band filter having a pass band the bandwidth of which is 96 [MHz]. In the example shown in FIG. 14, the band-pass filter 1A, to which the substrate #4 is mounted, functions as a pass band filter having a pass band the bandwidth of which is 102 [MHz].

Figure 15:
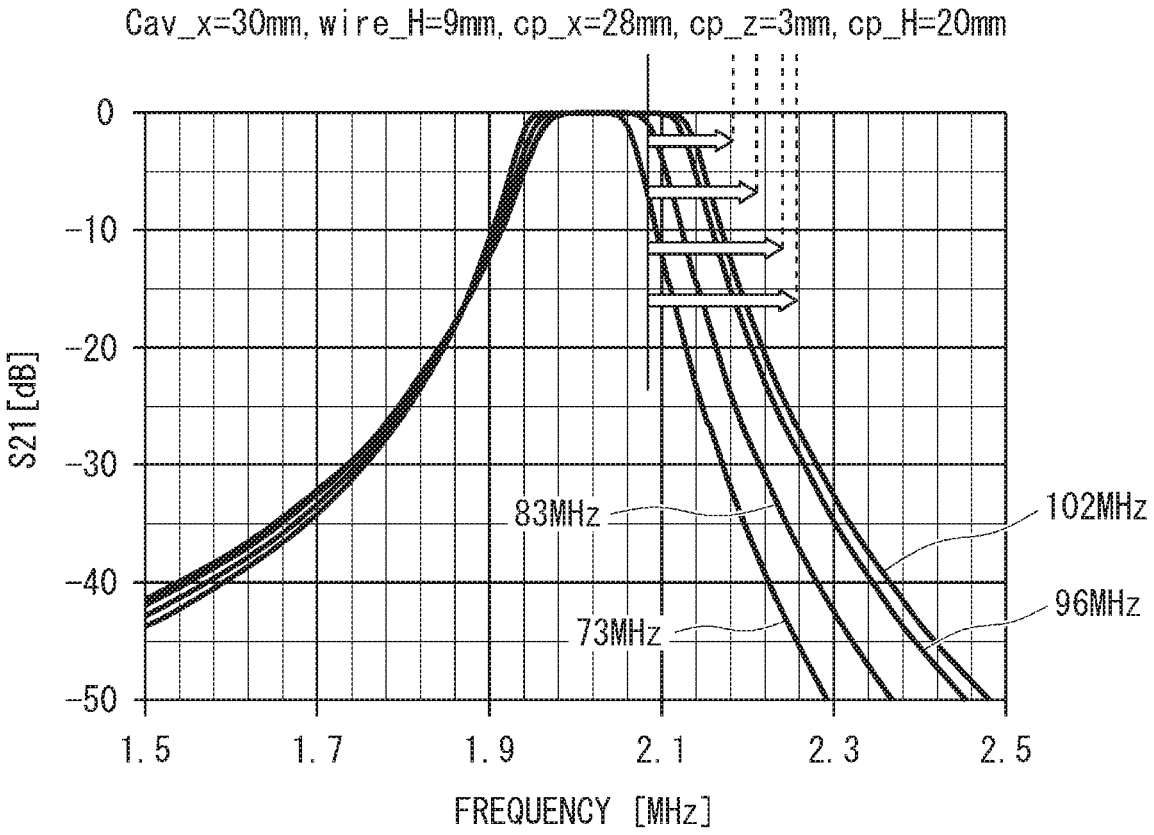
FIG. 15 is a diagram showing an example of a filter characteristic of the band-pass filter according to the first embodiment.

FIG. 15 is a diagram showing an example of the filter characteristic of the band-pass filter 1A according to the first embodiment, and shows that respective waveforms S21 shown in FIGS. 11 to 14 are superimposed.

FIG. 15 shows that the band-pass filter 1A according to the first embodiment has the filter characteristic that the lower-limit frequency of the pass band is not changed and the upper-limit frequency is changed according to the distance cp_dy. Specifically, the longer the distance cp_dy (the farther the second coupling conductors 16-1 and 16-2 with respect to the resonant plates 12-1 to 12-3), the higher the coupling coefficient, the higher the upper-limit frequency, and the broader the bandwidth.

As described above, the band-pass filter 1A according to the first embodiment has a configuration in which the two adjacent resonant plates 12 are connected by the first coupling conductor 15, the second coupling conductor 16 is arranged at a position affecting the coupling coefficient between the two adjacent resonant plates 12, and the distance (cp_dy) from the resonant plate 12 to the second coupling conductor 16 is changeable.

Accordingly, the coupling coefficient between the two adjacent resonant plates 12 is changed according to the distance cp_dy, and it is possible to change the bandwidth of the pass band. Furthermore, although the distance cp_dy is changed, the upper-limit frequency of the pass band is only changed while the lower-limit frequency is not changed, and it is possible to change the bandwidth while the center frequency of the band-pass filter 1A is hardly changed. Thus, it is possible to easily change the bandwidth of the pass band.

Furthermore, the band-pass filter 1A according to the first embodiment has a configuration in which the third coupling conductor 17 is arranged at a position affecting the external Q factor between the resonant plate 12 on each end and the input/output port 13, and the distance (sr_dy) from the resonant plate 12 to the third coupling conductor 17 is changeable.

Accordingly, it is possible to change, according to the distance sr_dy, the reflection delay uniquely determined according to the external Q factor, and to be consistent with the external circuit.

Here, the band-pass filter 1A according to the first embodiment may have a configuration in which the distances cp_dy and sr_dy are changed by, for example, configuring the substrate 18, on which the second coupling conductor 16 and the third coupling conductor 17 are mounted, to be attachable to and detachable from the housing 11 and replacing the substrate 18.

Accordingly, it is possible to change the bandwidth of the pass band only by replacing the substrate 18 while the main components, such as the housing 11 and the resonant plate 12, remain unchanged.

Alternatively, the band-pass filter 1A according to the first embodiment may have a configuration in which the distances cp_dy and sr_dy are changed by moving the substrate 18, on which the second coupling conductor 16 and the third coupling conductor 17 are mounted, in the y direction using a stepping motor (now shown) provided outside the band-pass filter 1A.

Accordingly, it is possible to change the bandwidth of the pass band while the substrate 18 as well as the main components, such as the housing 11 and the resonant plate 12, remain unchanged.

Furthermore, the band-pass filter 1A according to the first embodiment has a configuration in which the bandwidth of the pass band is changed by connecting the two adjacent resonant plates 12 by the first coupling conductor 15 and changing the coupling coefficient according to the distance cp_dy.

Accordingly, it is possible to determine the coupling coefficient by the shape and the position of the first coupling conductor 15, and a partition plate, which is often used for a semi-coaxial filter, for partitioning the two adjacent resonant plates 12 is unnecessary. Thus, the housing 11 does not need to be cut to form a partition plate and is easily processed, and which reduces the processing cost. In addition, if a partition plate is provided, the band-pass filter 1A is lengthened in the x direction by the thickness of the partition plate. However, the band-pass filter 1A according to the first embodiment does not need a partition plate and can be downsized in the x direction. Furthermore, the shape of a partition plate and the interval between adjacent resonators is normally used as parameters to design the coupling coefficient in a semi-coaxial filter, but a desired coupling coefficient can be designed by selecting the shape and the position of the first coupling conductor 15 without such parameters in the first embodiment. Thus, it is possible not only to downsize a filter in the x direction, but also to manufacture a filter having an arbitrary length in the x direction.

(2) Second Embodiment

Figure 16:
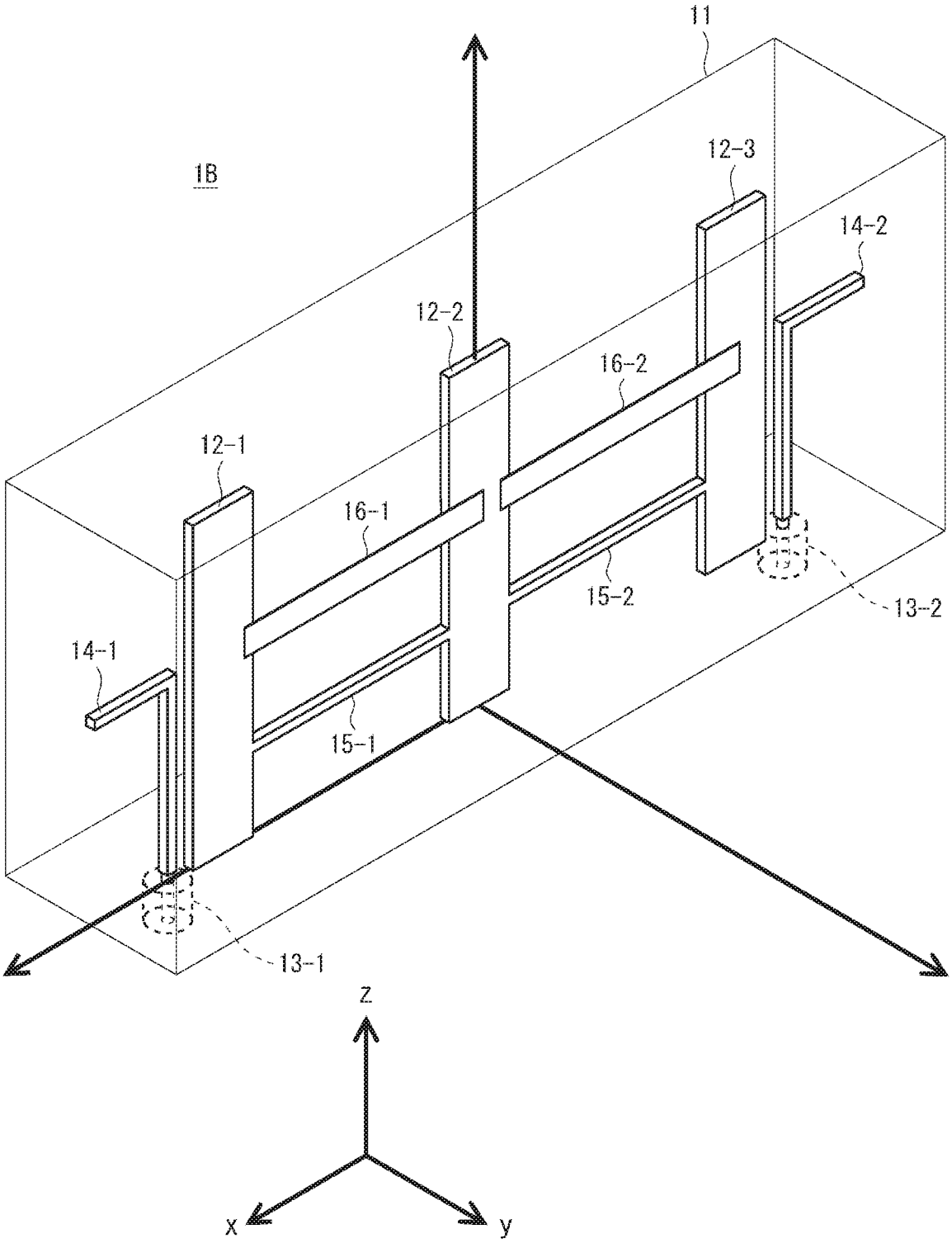
FIG. 16 is a perspective view showing an example of a band-pass filter according to a second embodiment.
Figure 17:
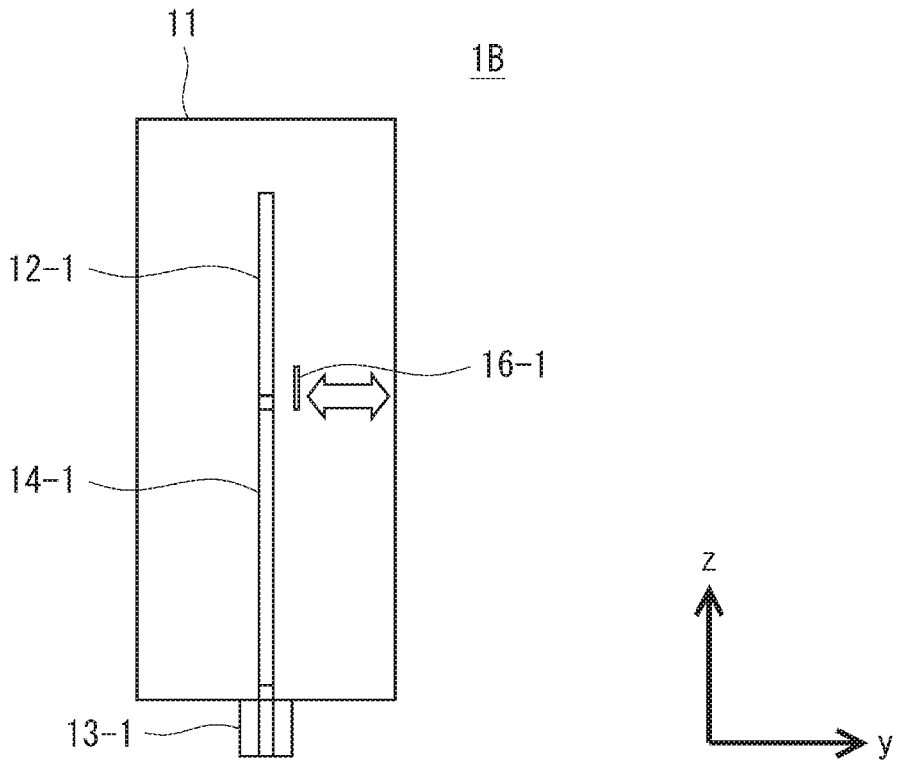
FIG. 17 is a side view showing an example of a band-pass filter according to the second embodiment.
Figure 18:
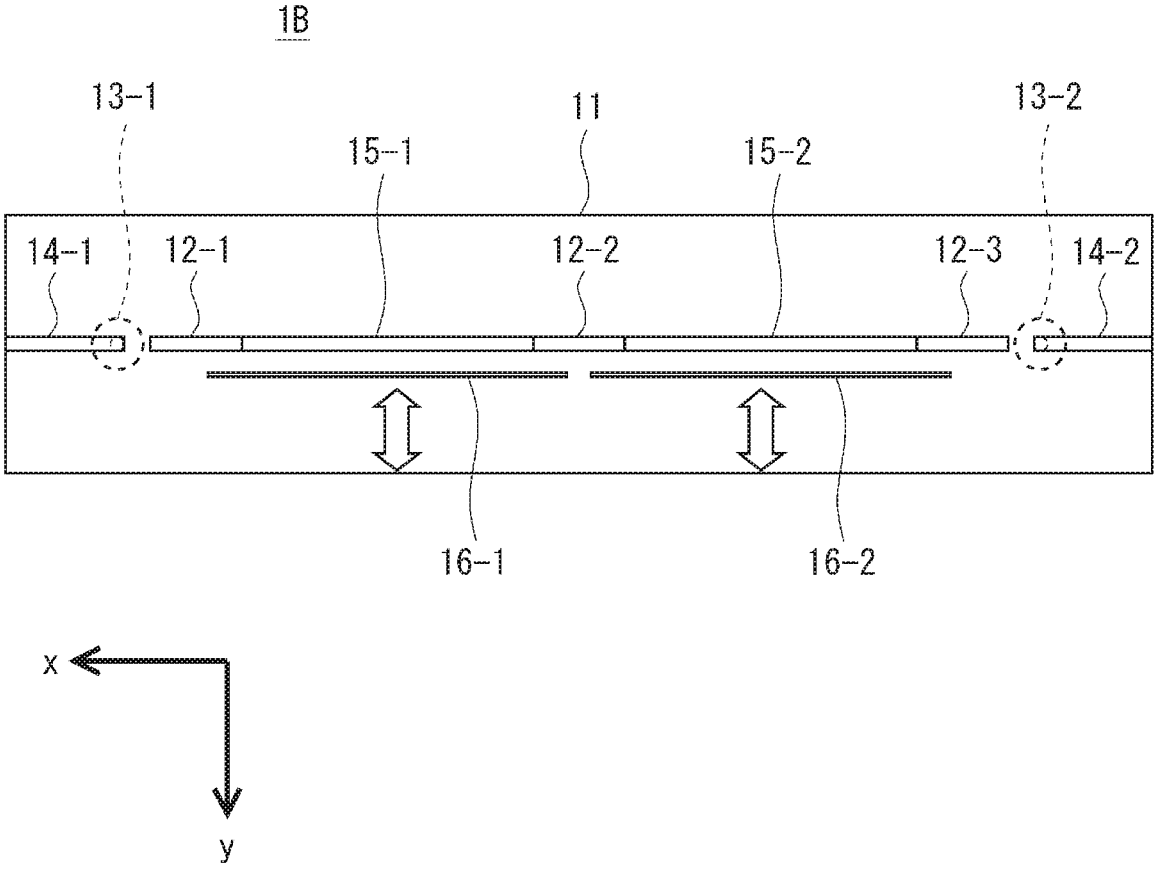
FIG. 18 is a top view showing an example of a band-pass filter according to the second embodiment.

FIGS. 16 to 18 are respectively a perspective view, a side view, and a top view showing an example of a band-pass filter 1B according to a second embodiment.

As shown in FIGS. 16 to 18, the band-pass filter 1B according to the second embodiment has a configuration in which the third coupling conductors 17-1 and 17-2 are removed from the band-pass filter 1A according to the first embodiment. The configuration other than this in the second embodiment is similar to that in the first embodiment.

The third coupling conductors 17-1 and 17-2 are provided to adjust an external Q factor (to be consistent with an external circuit) as described above. Thus, when deterioration in return loss is little or allowable and the external Q factor does not need to be adjusted, the third coupling conductors 17-1 and 17-2 can be removed as in the band-pass filter 1B according to the second embodiment.

In the band-pass filter 1B according to the second embodiment, second coupling conductors 16-1 and 16-2 are mounted on a substrate, and the principal surface of the substrate is opposed to the principal surfaces of resonant plates 12-1 to 12-3. Then, the position of the second coupling conductors 16-1 and 16-2 mounted on the substrate is changed in the y direction to change the distance cp_dy.

Figure 19:
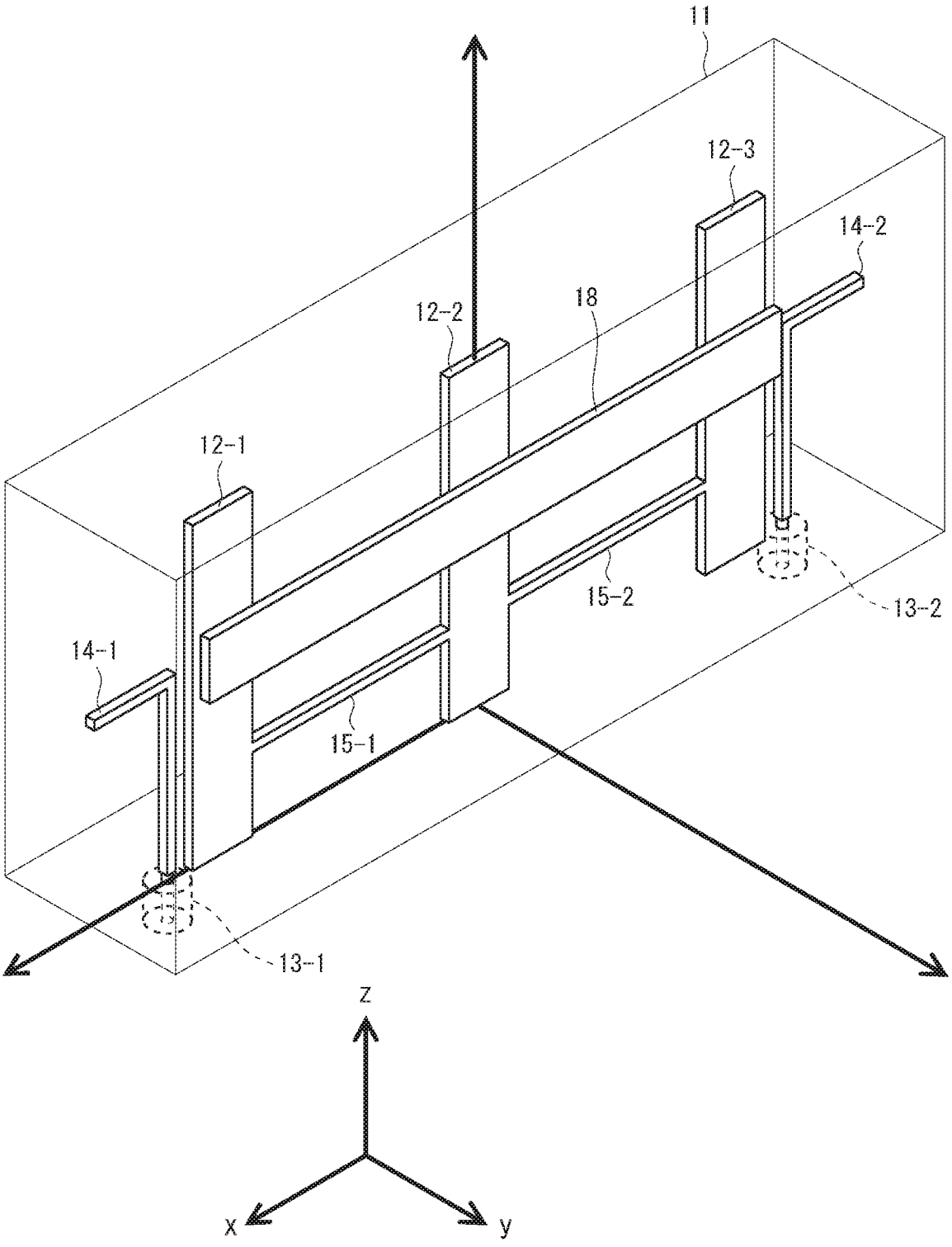
FIG. 19 is a perspective view showing an example of the band-pass filter according to the second embodiment to which a substrate is mounted.
Figure 20:
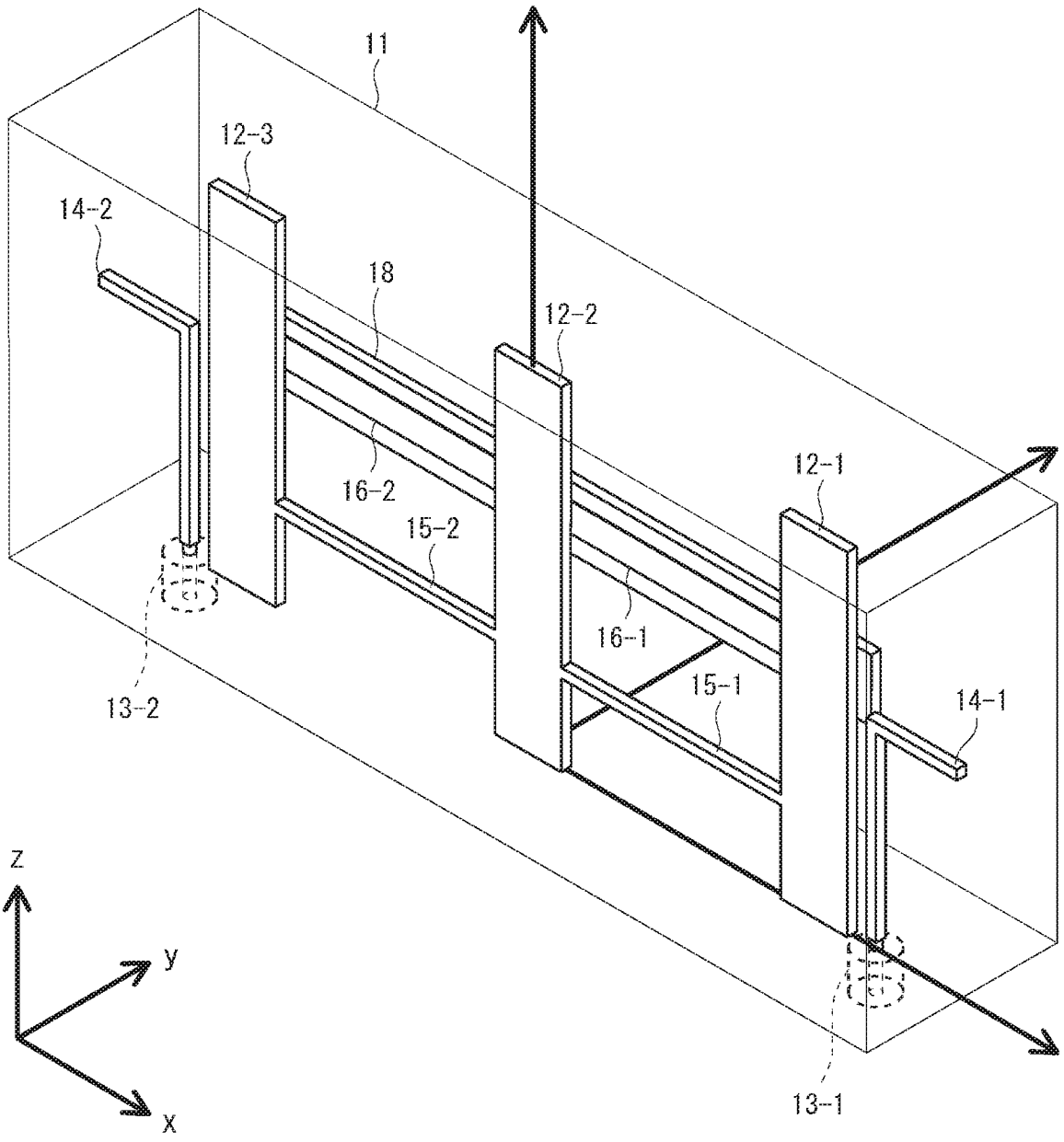
FIG. 20 is a perspective view of the band-pass filter in FIG. 19 when viewed from the back side.

In the example shown in FIGS. 19 and 20, the second coupling conductors 16-1 and 16-2 are mounted on the face of the substrate 18 opposed to the resonant plates 12-1 to 12-3. The second coupling conductors 16-1 and 16-2 may be mounted on one surface of the substrate 18 in this manner or on both surfaces of the substrate 18 and connect both surfaces via through holes when the second coupling conductors 16-1 and 16-2 are thick. When the second coupling conductors 16-1 and 16-2 are mounted on one surface of the substrate 18, the second coupling conductors 16-1 and 16-2 may be mounted either on the face opposed to the resonant plates 12-1 to 12-3 or on the surface on the back side of the above surface.

Here, in the case of the substrate 18 shown in FIGS. 19 and 20, by attaching a supporting rod (now shown) to the substrate 18 and moving the supporting rod in the y direction using a stepping motor (now shown) provided outside the band-pass filter 1B, the substrate 18 is configured to be movable in the y direction. Then, by moving the substrate 18 in the y direction to change the position of the second coupling conductors 16-1 and 16-2 in the y direction, and it is possible to change the distance cp_dy.

However, the distance cp_dy may be changed by configuring the substrate 18 to be attachable to and detachable from a substrate mounting part (not shown) in the housing 11 and replacing the substrate 18 with another substrate 18 having a different distance cp_dy when mounted to the housing 11.

As described above, the band-pass filter 1B according to the second embodiment has a configuration in which the two adjacent resonant plates 12 are connected by the first coupling conductor 15, the second coupling conductor 16 is arranged at a position affecting the coupling coefficient between the two adjacent resonant plates 12, and the distance (cp_dy) from the resonant plate 12 to the second coupling conductor 16 is changeable, similarly to the band-pass filter 1A according to the first embodiment.

Thus, it is possible to easily change the bandwidth of the pass band similarly to the band-pass filter 1A according to the first embodiment. The other effects are similar to that in the first embodiment except that an external Q factor is adjustable (to be consistent with an external circuit).

While the present disclosure has been particularly shown and described with reference to embodiments thereof, the present disclosure is not limited to these embodiments. It will be understood by those of ordinary skill in the art that various changes in form and details may be made therein without departing from the spirit and scope of the present disclosure as defined by the claims.

For example, it has been exemplified that second coupling conductor and third coupling conductor are mounted on the same substrate in the first embodiment. However, the band-pass filter according to the present disclosure is not limited thereto, and the second coupling conductor and the third coupling conductor may be separately mounted on two respective substrates. When the distances cp_dy and sr_dy are changed by moving the substrates in the y direction in this configuration, the two substrates may be moved together by the same stepping motor or respective stepping motors, or moved separately by respective stepping motors. Furthermore, when the distances cp_dy and sr_dy are changed by replacing the substrates, the two substrates may be replaced together, or either one may be replaced.

This application is based upon and claims the benefit of priority from Japanese Patent Application No. 2016-101808, filed on May 20, 2016, the disclosure of which is incorporated herein in its entirety by reference.

REFERENCE SIGNS LIST

1A, 1B BAND-PASS FILTER
11 HOUSING
12-1 to 12-3 RESONANT PLATE
13-1, 13-2 INPUT/OUTPUT PORT
14-1, 14-2 LOOP ANTENNA
15-1, 15-2 FIRST COUPLING CONDUCTOR
16-1, 16-2 SECOND COUPLING CONDUCTOR
17-1, 17-2 THIRD COUPLING CONDUCTOR
18 SUBSTRATE

What is claimed is:

1. A band-pass filter comprising:
a housing;
a plurality of resonant plates stored in the housing;
a first coupling conductor connecting two adjacent resonant plates of the plurality of resonant plates;
a second coupling conductor arranged at a position affecting a coupling coefficient between the two adjacent resonant plates;
a line arranged at two ends of the housing; one of the plurality of resonant plates disposed at each of the two ends,
a third coupling conductor arranged at a position affecting an external Q factor between the resonant plate at each end and the corresponding line,
wherein a distance from one of the two adjacent resonant plates to the second coupling conductor is changeable, and
wherein a distance from another one of the two adjacent resonant plates to the third coupling conductor is changeable.

2. The band-pass filter according to claim 1, wherein
the first coupling conductor has a plate shape, and
the plurality of resonant plates and the first coupling conductor are integrally formed in a plate shape.

3. The band-pass filter according to claim 1, further comprising a substrate on which the second coupling conductor and the third coupling conductor are mounted, the substrate having a principal surface arranged to be opposed to a principal surface of the one of the two adjacent resonant plates.

4. The band-pass filter according to claim 3, wherein the substrate is configured to be movable in a direction orthogonal to the principal surface of the one of the two adjacent resonant plates, and the distance from the second coupling conductor mounted on the substrate to the one of the two adjacent plates and the distance from the third coupling conductor mounted on the substrate to the another one of the resonant plates are changed by moving the substrate in the direction orthogonal to the principal surface of the one of the two adjacent resonant plates.

5. The band-pass filter according to claim 1, wherein the third coupling conductor is arranged between the respective resonant plate at each of the two ends and the corresponding line.

6. The band-pass filter according to claim 1, wherein the second coupling conductor has a plate shape having a principal surface opposed to a principal surface of the one of the two adjacent resonant plates.

7. The band-pass filter according to claim 1, wherein each of the plurality of resonant plates has one end connected to the housing and the another end which is an open end, and the second coupling conductor extends over the two adjacent resonant plates, and is arranged closer to the open end of the one of the two resonant plates than the first coupling conductor is.

8. A control method of a band-pass filter including a plurality of resonant plates stored in a housing, the control method comprising:

connecting two adjacent resonant plates of the plurality of resonant plates by a first coupling conductor;

arranging a second coupling conductor at a position affecting a coupling coefficient between the two adjacent resonant plates;

arranging a line at two ends of the housing;

one of the plurality of resonant plates disposed at each of the two ends, arranging a third coupling conductor at a position affecting an external Q factor between the resonant plate at each end and the corresponding line;

changing a distance from one of the two adjacent resonant plates to the second coupling conductor; and changing a distance from another of the two adjacent resonant plates to the third coupling conductor.

* * * * *